US010407909B2

(12) United States Patent
Dietzen et al.

(10) Patent No.: US 10,407,909 B2
(45) **Date of Patent: *Sep. 10, 2019**

(54) TRUSS ASSEMBLY

(71) Applicant: Keith Dietzen, Boulder, CO (US)

(72) Inventors: Keith Dietzen, Boulder, CO (US); John Woods, Boulder, CO (US); Anwar Merchant, Boulder, CO (US)

(73) Assignee: Keith Dietzen, Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/367,998

(22) Filed: Mar. 28, 2019

(65) Prior Publication Data

US 2019/0218777 A1 Jul. 18, 2019

Related U.S. Application Data

(62) Division of application No. 14/879,411, filed on Oct. 9, 2015.

(60) Provisional application No. 62/062,438, filed on Oct. 10, 2014.

(51) Int. Cl.

| | |
|---|---|
| ***E04C 3/04*** | (2006.01) |
| ***E04C 3/11*** | (2006.01) |
| ***E04C 3/08*** | (2006.01) |
| ***E04C 3/07*** | (2006.01) |

(52) U.S. Cl.

CPC ..... *E04C 3/04* (2013.01); *E04C 3/08* (2013.01); *E04C 3/11* (2013.01); *E04C 3/07* (2013.01); *E04C 2003/0491* (2013.01)

(58) Field of Classification Search

CPC ..... E04C 3/04; E04C 3/08; E04C 3/11; E04C 2003/0491; E04C 3/07

See application file for complete search history.

(56) References Cited

U.S. PATENT DOCUMENTS

| | | | | |
|---|---|---|---|---|
| 3,310,922 A | | 3/1967 | Hoffmann, Jr. | |
| 3,611,659 A | | 10/1971 | Greenhalgh | |
| 3,680,271 A | | 8/1972 | Satchell | |
| 3,760,550 A | | 9/1973 | Mueller et al. | |
| 3,826,057 A | * | 7/1974 | Franklin | E04C 3/08 52/641 |

(Continued)

FOREIGN PATENT DOCUMENTS

| | | | | |
|---|---|---|---|---|
| CN | 203498746 U | | 3/2014 | |
| GB | 967389 A | * | 8/1964 | E04B 1/5818 |

(Continued)

*Primary Examiner* — Basil S Katcheves
*Assistant Examiner* — Omar F Hijaz
(74) *Attorney, Agent, or Firm* — Notaro, Michalos & Zaccaria P.C.

(57) ABSTRACT

A metal truss assembly comprises a plurality of C-shape structural members including at least one chord member and two or more adjacent web members, each structural member having a base and two opposing flanges. The at least one C-shape chord member has flanges extending from each side of the base with one flange having cutouts to receive two C-shape web members with a part of said flange of said chord member in place between said cutouts. Each said C-shape web member is placed into one of the cutouts in said flange to intersect the at least one chord member with the bases of the two C-shape web members adjacent the base of the at least one chord member.

12 Claims, 16 Drawing Sheets

(56) References Cited

U.S. PATENT DOCUMENTS

| | | | | | |
|---|---|---|---|---|---|
| 3,883,999 | A | | 5/1975 | Nicoll, Jr. | |
| 4,616,453 | A | * | 10/1986 | Sheppard, Jr. | E04C 3/07 52/478 |
| 4,637,323 | A | | 1/1987 | Nicely | |
| 4,688,358 | A | * | 8/1987 | Madray | E04B 1/24 403/171 |
| 4,854,096 | A | | 8/1989 | Smolik | |
| 5,406,763 | A | | 4/1995 | Al-Saleh | |
| 5,704,170 | A | | 1/1998 | Simpson | |
| 5,857,292 | A | | 1/1999 | Simpson | |
| 5,964,072 | A | | 10/1999 | Rasmussen | |
| 6,757,643 | B2 | | 6/2004 | Gavin et al. | |
| 7,735,294 | B2 | | 6/2010 | Moody et al. | |
| 7,963,013 | B2 | | 6/2011 | Sluiter | |
| 8,006,461 | B2 | | 8/2011 | Moody et al. | |
| 8,818,547 | B2 | | 8/2014 | McAdoo et al. | |
| 2002/0059774 | A1 | | 5/2002 | Collins | |
| 2004/0163356 | A1 | | 8/2004 | Rice | |
| 2005/0217185 | A1 | | 10/2005 | Moulton et al. | |
| 2007/0151200 | A1 | | 7/2007 | Madray | |
| 2008/0222989 | A1 | | 9/2008 | Greeff et al. | |
| 2012/0272607 | A1 | | 11/2012 | Cooper | |
| 2014/0000208 | A1 | | 1/2014 | Vanker et al. | |
| 2014/0102590 | A1 | | 4/2014 | Towey | |
| 2014/0338279 | A1 | | 11/2014 | Armbrust et al. | |

FOREIGN PATENT DOCUMENTS

| | | | | | |
|---|---|---|---|---|---|
| GB | 2233681 | A | | 1/1991 | |
| WO | WO-9415041 | A1 | * | 7/1994 | E01D 6/00 |
| WO | 9622428 | A1 | | 7/1996 | |
| WO | WO-0183906 | A1 | * | 11/2001 | E04C 3/09 |
| WO | WO-02053851 | A1 | * | 7/2002 | B21D 5/08 |
| WO | 2004051014 | A1 | | 6/2004 | |
| WO | 2006053368 | A1 | | 5/2006 | |
| WO | 2007091903 | A1 | | 8/2007 | |

* cited by examiner

TRUSS ASSEMBLY

CROSS-REFERENCE TO RELATED APPLICATION

This is a divisional of U.S. application Ser. No. 14/879,411, filed Oct. 9, 2015, which claims priority on U.S. Provisional Patent Application 62/062,438, filed on Oct. 10, 2014, both of which are incorporated herein by reference.

BACKGROUND AND SUMMARY OF THE INVENTION

Metal truss assemblies have been widely used as structural members in building construction, and particularly in metal and high rise buildings. The metal truss assemblies are used for roof and floor structural framing on which the floor and roof materials are fastened. A roof or floor truss assembly generally comprise a top chord member and bottom chord member, with various web members running between them.

In roof truss assemblies, the ends of the top chord are secured to opposite ends of the bottom chord to form the perimeter of the roof truss with the roof peak formed by the top chord between. In floor truss assemblies, the top and bottom chords are positioned substantially in parallel. In both roof and floor truss assemblies, one or more web members span between and interconnect the top and bottom chords with at their end portions secured to the top chord(s) and to the bottom chord(s).

When erected in building frames, a plurality of the floor or roof truss assemblies position in parallel spanning the wall structures of the building and fixed to the top of bearing wall support frames. With floor trusses assemblies, the sub-roof and floor materials are then assembled across the top chords, and with roof truss assemblies, ceiling material may be fastened across the bottom chords and roof material may be fastened across the top chords. The reactions resulting from the combined roof loads and wind loads, plus the dead loads of the roof truss assemblies and roof and other transferred loads by the truss assemblies to the top of bearing wall support frames.

Various types of metal truss assemblies are available which require additional support members or brackets to attach together the chord and web members. Additionally, the chord and web members are assembled in a back-to-back orientation. Alternatively, the web members may fit within the chord member along a weak axis orientation. These known designs have a number of disadvantages including increased material and labor, more shipping volume, problems with stacking and higher cost.

There is a need to provide a cost competitive light weight easily assembled metal roof truss assembly yet still be structurally sufficient to withstand various loads. Disclosed is a metal truss assembly comprising:

a plurality of C-shape structural members including at least one chord member and two or more adjacent web members, each structural member having a base and two opposing flanges;

the at least one C-shape chord member having flanges extending from each side of the base with one flange having cutouts to receive two C-shape web members with a part of said flange of said chord member in place between said cutouts; and each said C-shape web member placed into one of the cutouts in said flange to intersect the at least one chord member with the bases of the two C-shape web members adjacent the base of the at least one chord member.

In any case, the bases of each of the two or more adjacent web members and the at least one chord member may have the same width and the part of the chord flange between the two web members may be a cutout with a length that is less than the width of each of the adjacent web members. The two or more adjacent web members may intersect the at least one chord member at different angles. The part of the chord flange forming a cutout between web members may have a length of at least 1½ inches measured at the base of the at least one chord member.

The C-shape structural members may be easily assembled by directly attaching together the bases of chords and webs from one side. The C-shape structural members may be formed from a light gauge metal. Each C-shape structural member may have a lip on each flange extending inwardly from the flange. The lip of the part of the chord flange may have a length of at least ⅜ inches extending inwardly from the flange.

In assembly, each C-shape chord and web member may have a centerline axis and pilot holes may be provided in the base along the centerline axis of each web and chord member to provide alignment in assembly of chord and web members. The pilot holes in the web members are aligned and secured with fasteners to the at least one chord for orientation.

The metal truss assembly may further include a gusset plate for securing the two or more adjacent web members to the at least one chord member.

The metal truss assembly may further include a first line of markers which are provided in the base of each C-shape web member located inwardly a first distance from a free edge of an end of each of the C-shape web members to mark fastener locations for assembly with fasteners. A second line of markers may be located inwardly a second distance from an edge of the cutout of one C-shape chord member where the web member is to be assembled to mark fastener locations for assembly. At least two fasteners may be placed along each of the first distance and the second distance. The at least two fasteners placed along each of the first distance and the second distance may form a trapezoid and additional fasteners may be optionally provided in the trapezoid as desired. The first distance and the second distance may be the same, and may both be at least 9/16.sup.th inches. The first line of markers and the second line of markers may indicate the location of screw holes.

An alignment hole may be located at the intersection of the midpoint of the width of the at least one chord member and the midpoint of the width of one of the adjacent web members.

At least some of the C-shape members of the metal truss assembly may include joint markings in accordance to a computer program of the desired metal truss assembly to provide for ease of assembly at the assembly location. At least some of the C-shape members may further include fastener markings in accordance to a computer program of the desired metal truss assembly to provide for ease of assembly at the assembly location. The gusset plate may also include fastener markings in accordance to a computer program of the desired metal truss assembly to provide for ease of assembly at the assembly location.

At least some of the C-shape members of the metal truss assembly may be pre-partially cut in accordance to a computer program of the desired metal truss assembly so that bundles of the plurality of C-shape members can be sent to an assembly location and be subsequently separated for assembly of the metal truss assembly in accordance with the computer program thereof. Some of the C-shape members may be pre-partially cut through the opposing flanges of each C-shape member. Some of the C-shape members may be further pre-partially cut through a portion of the base of each C-shape member.

Also disclosed is metal truss assembly, comprising:

a plurality of C-shape structural members including a first chord member, a second chord member and at least two web members, each structural member having a base and two opposing flanges having opposite end portions; and each C-shape chord member having at least two spaced apart chord cutouts and a chord flange with each cutout to receive one of the C-shape web members on assembly of the web members with the chord members forming an intersection of chord members and web members with the bases on the chord members and web members directly attached.

The assembly of the web members with the chord members form an intersection of chord members and web members with the bases on the chord members and web members directly attached. The first chord member may be substantially parallel to the second chord member. Alternatively, the first chord member may be traverse to the second chord member.

In any case, the bases of the chord members may have the same width. The part of the chord flange between two cutouts may have a length that is less than the width of each of the web members on assembly. Alternatively, the part of the chord flange between adjacent cutouts may have a length that is greater than the width of each of the adjacent web members on assembly. In yet another embodiment, the part of the chord flange between the cutouts may each have a length that is less than a width of any one of the bases of each of the two or more adjacent web members and the at least one chord member. The two or more adjacent web members may intersect a chord member at different angles. The two or more adjacent web members may also intersect a second chord member at different angles. The part of the chord flange between the two cutouts may have a length of at least 1½ inches measured at the base of the chord member. The length of part of the chord flange may be at least 1½ inches.

The C-shape structural members may be easily assembled by directly attaching together the bases of chords and webs from one side. The C-shape structural members may be formed from light gauge metal. Each C-shape structural member may have a lip on each flange extending inwardly from the flange. The lip of the part of the chord flange between the two cutouts may have a length of at least ⅜ inches extending inwardly from the flange.

In assembly, each C-shape web member may have a centerline axis and pilot holes may be provided in the base along the centerline axis of each web and chord member to provide alignment in assembly of the first chord member and the second chord member. The pilot holes in the web members may be aligned and secured with fasteners to the first and second chord members for orientation.

The metal truss assembly may further include at least one gusset plate for securing the two or more web members to one of the first chord member and the second chord member.

The metal truss assembly may further include a first line of markers which are provided in the base of each C-shape web member located inwardly a first distance from a free edge of an end of each of the C-shape web members to mark fastener locations for assembly with fasteners. A second line of markers may be located inwardly a second distance from an edge of the cutout of one C-shape chord member where the web member is to be assembled to mark fastener locations for assembly. At least two fasteners may be placed along each of the first distance and the second distance. The at least two fasteners placed along each of the first distance and the second distance may form a trapezoid and optionally providing additional fasteners in the trapezoid as desired. The first distance and the second distance may be the same, and may both be at least 9/16.sup.th inches. The first line of markers and the second line of markers may indicate the location of screw holes.

An alignment hole may be located at the intersection of the midpoint of the width of the chord member and the midpoint of the width of one of the web members.

The foregoing and other objects, features and advantages of the invention will be apparent from the following more detailed descriptions of particular embodiments of the invention, as illustrated in the accompanying drawing wherein like reference numbers represent like parts of the invention.

DETAILED DESCRIPTION OF PARTICULAR EMBODIMENTS

Figure 1:
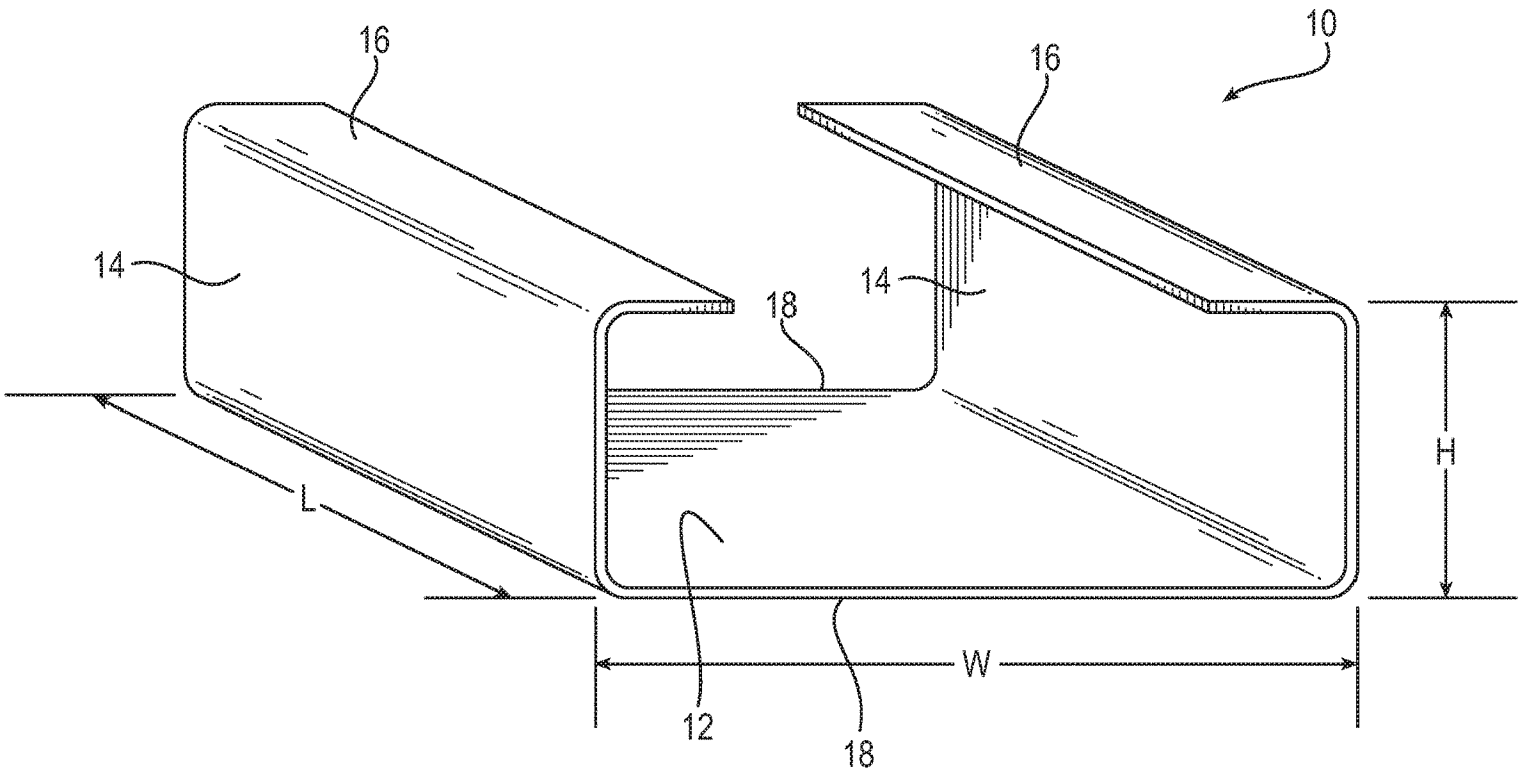
FIG. 1 is a perspective view of a C-shape structural member according to an embodiment of the invention.

FIG. 1 illustrates a C-shape structural member 10 in accordance with an embodiment of the present invention. The C-shape structural member 10 includes a base 12 and opposing flanges 14 extending from each side of the base 12. Each flange 14 may extend substantially perpendicular from the base 12. The C-shape structural member 10 also includes a lip or return 16 on each flange 14 extending inwardly from the flange 14. The lip 16 may extend substantially perpendicular to the flange 14 and substantially parallel to the base 12. The C-shape structural member 10 includes a length, a width or depth and a height. The length L is the distance measured between opposing ends 18 of the base 12. The width W is the distance measured between the opposing flanges 14. The height is the distance measured between the base 12 and the lip 16 of C-shape structural member 10.

The width or depth 12 of the C-shape structural member 10 may be in the range of 2.5 to 16 inches. The height of the C-shape structural member may be in the range of 1⅜ to 3.5 inches. The lip or return 16 of the C-shape structural member may have a width of ⅜ to 1 inches. The C-shape structural members may be formed from a light gauge metal such as steel or any other known material. The material may be cold rolled steel hot galvanized to a thickness of anywhere between 12 to 26 gauge.

Figure 2:
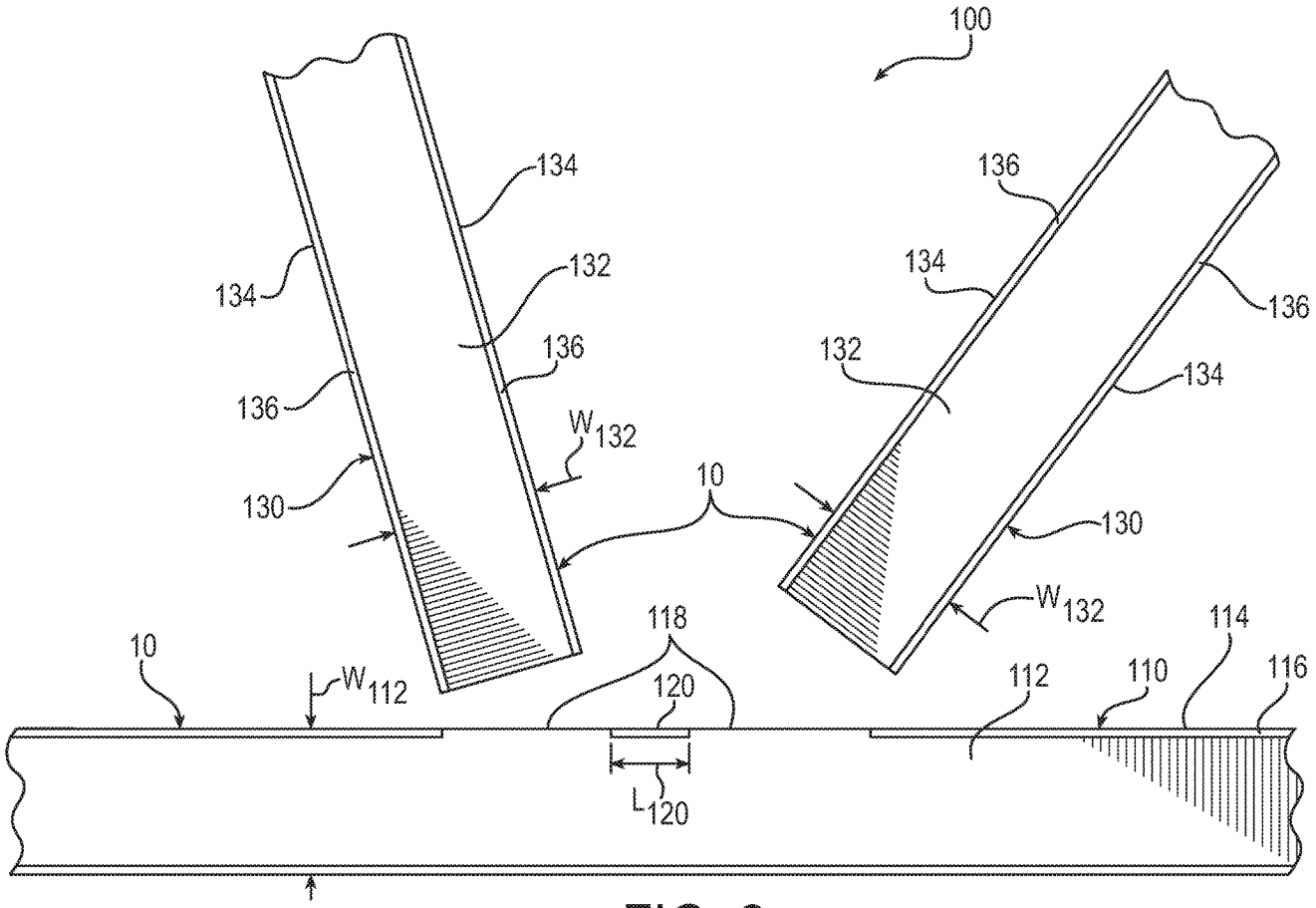
FIG. 2 is an exploded front view of a metal truss assembly according to another embodiment of the present invention.
Figure 3:
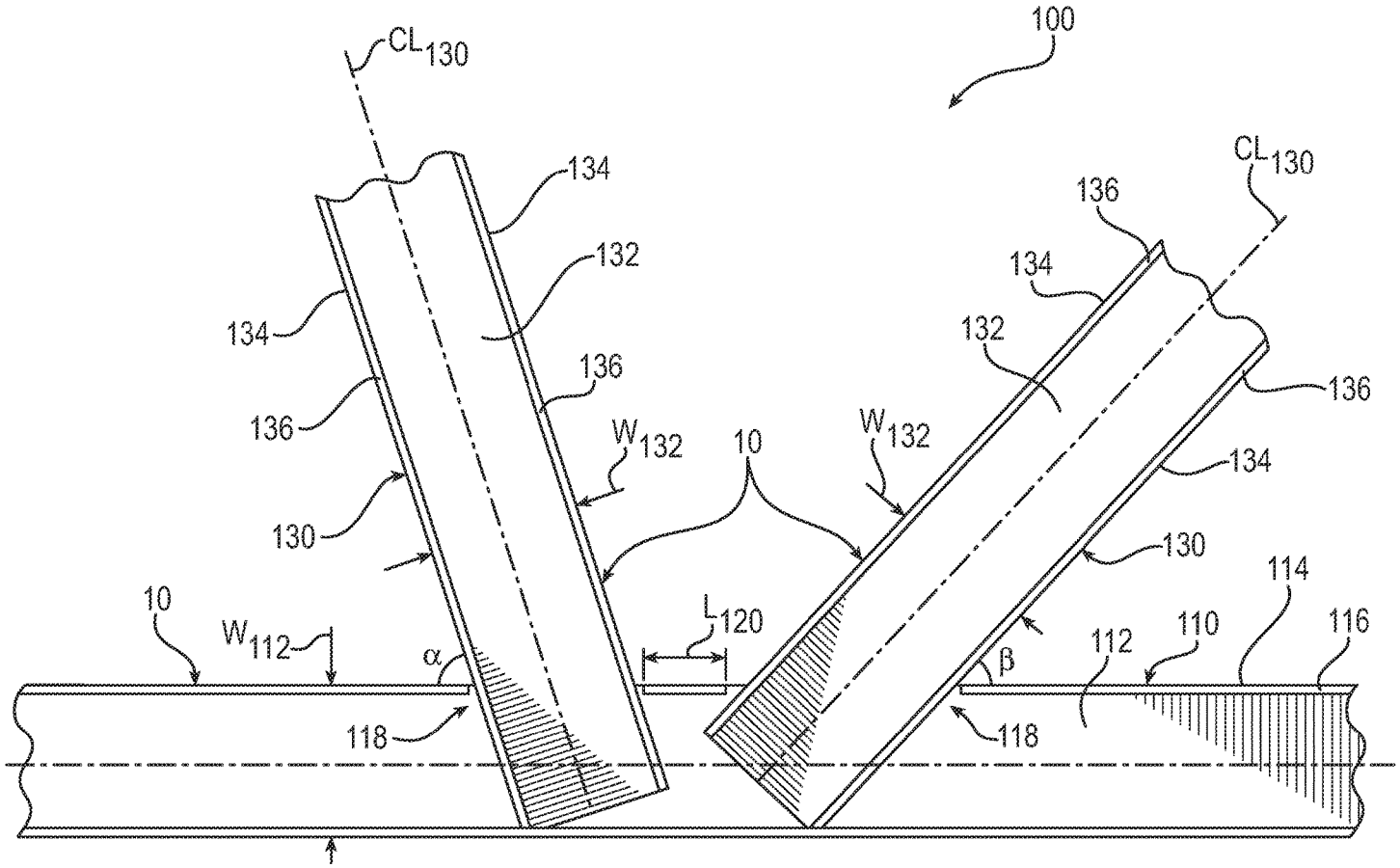
FIG. 3 is a front view of the metal truss assembly as shown in FIG. 2.

A metal truss assembly 100 including a plurality of C-shape structural members 10 is shown in FIGS. 2 and 3. FIG. 2 displays an exploded view of the metal truss assembly 100 while FIG. 3 shows the metal truss assembly 100 in the assembled state. The plurality of C-shape structural members 10 include a chord member 110 and web members 130. The web members 130 are adjacent to each other and transverse to the chord member 110. The chord member 110 includes a base 112 and has flanges 114 extending from each side of the base 112. A lip or return 116 extends inwardly from each flange 114. Similarly, each web member 130 includes a base 132 and has flanges 134 extending from each side of the base 132. A lip or return 136 extends inwardly from each flange 134.

One flange 114 of the chord member 110 includes cutouts 118 to receive the web members 130 with a part 120 of the flange 114 of the chord member 110 remaining in place between the cutouts 118. As seen in FIG. 3, each web member 130 is placed into one of the cutouts 118 in the flange 114 of the chord member 110 to intersect the chord member 110 with the bases of the web members 130 adjacent the base 112 of the chord member 110. The intersection of the web members 130 and the chord member 110 is known as the cope. Retaining the part 120 of the flange 114 of the chord member 110 between the web members 130 within the cope significantly increases the strength of the connection. The part 120 of the flange 114 of the chord member 110 also facilitates the fabrication process by providing a guide as to the exact location of the web members intersecting the chord member 110.

The bases 132 of each of the web members 130 each have a width W.sub.132 and the base of the chord member has a width W.sub.112. In the embodiment shown in FIGS. 2 and 3, the width W.sub.132 of the bases 132 of the web members 130 is the same as the width W.sub.112 of the base 112 of the chord member 110. The part 120 of the chord flange 114 between the two cutouts 118 has a length L.sub.120. In this embodiment, the length L.sub.120 is less than the width W.sub.112 of each of the web members 130. The length L.sub.120 of the part 120 of the chord flange 114 between the two cutouts 118 may be at least 1½ inches.

In the embodiment of FIGS. 2 and 3, the C-shape structural members 14 are oriented to directly attach together the base 112 of the chord member 110 and the bases 132 of the web members 130 from one side. This is known as a strong-oriented truss where the structural members are oriented along the strong axis as opposed to the weak axis. The strong axis is also known as the major axis. A fully braced section bent about this axis has the highest resistance from the section. Similarly the weak axis is also known as the minor axis. A section will see least amount of resistance if it were to bent about this axis.

As shown in FIG. 3, the web members 130 intersect the chord member 110 at different angles .alpha. and .beta. The angles .alpha. and .beta. are measured between the flange 134 of the web member 130 and the flange 114 of the chord member 110 as seen in FIG. 3. Alternatively, the web members 130 may intersect the chord member 110 at the same angle. Each web member 130 may intersect the chord member 110 at any angle between 0 and 180 degrees.

Figure 4:
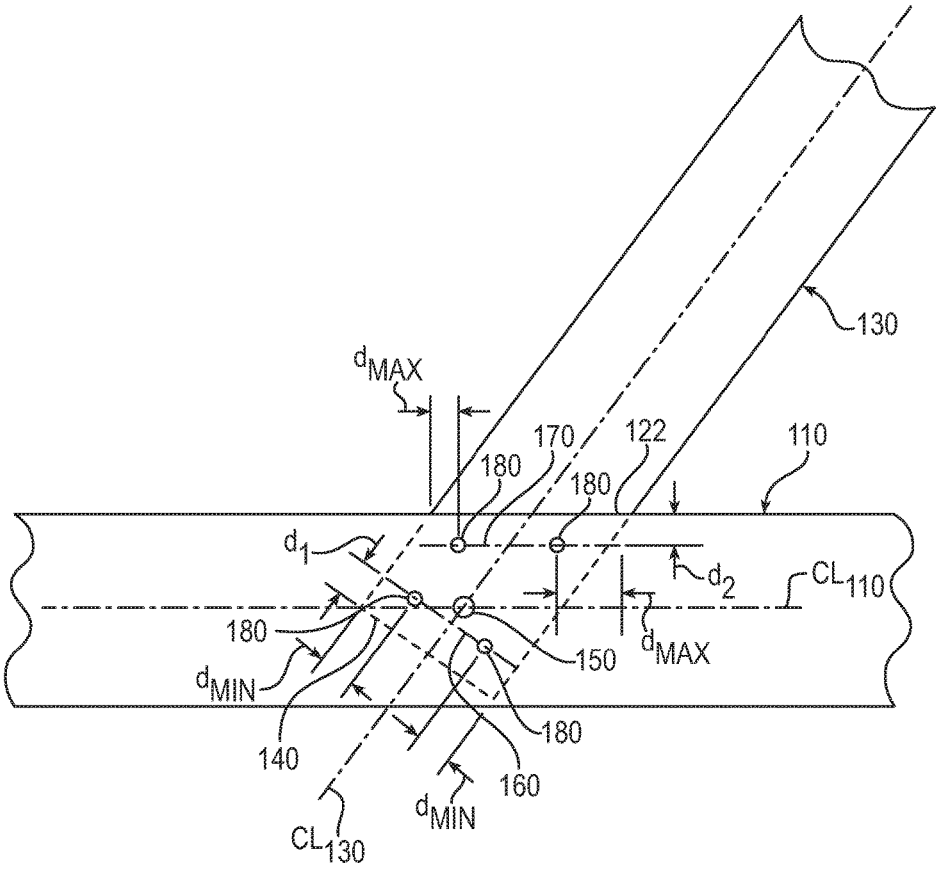
FIG. 4 is a rear view of a web member intersecting a chord member according to an embodiment of the present invention.

With reference to FIG. 4, a rear view of the web member 130 is shown connected with the chord member 110. In order to locate the base 132 of the web member 130 with the base 112 of the chord member 110, an alignment hole 150 is located at the intersection of a centerline axis CL of the web member 130 and a centerline axis CL of the chord member as seen in FIG. 4. The alignment hole 150 provides alignment in assembly of the chord member 110 and the web member 130.

In order to locate fasteners to secure the web member 130 to the chord member 110, a first line of markers 160 is provided in the base of the web member 130. The first line of markers 160 is located inwardly a first distance d.sub.1 from a free edge of an end 140 of the web member 130 to mark fastener locations for assembly with fasteners. The first line of markers 160 is parallel to the free edge of the end 140 of the web member 130.

A second line of markers 170 is provided in the base of the chord member 110 for connecting the web member 130. The second line of markers 170 is located inwardly a second distance d.sub.2 from an edge 122 of the cutout 118 of the chord member 110 where the web member 130 is to be assembled to mark fastener locations for assembly. The second line of markers 170 is parallel to the edge 122 of the cutout 118 of the chord member 110. The first distance d.sub.1 and the second distance d.sub.2 may be the same, and may both be at least 9/16.sup.th inches. The first line of markers 160 and the second line of markers 170 indicate the location holes for fasteners.

As seen in FIG. 4, two fasteners 180 are placed along the first line of markers 160. Each fastener 180, of the two fasteners placed along the first line of markers 160, is located inwardly a distance d.sub.min from each respective flange 134 of the web member 130 on the base 112 of the chord member 110. The distance d.sub.min is a minimum distance that is equal to the formula of 1.5.times. the fastener diameter of the fastener 180. This fastener diameter may be a screw diameter. Two fasteners 180 are also placed along the second line of markers 170. Each of the two fasteners 180 along the second line of markers 170 is located a distance d.sub.max inwardly from each respective flange 134 of the web member 112 on the base of the chord member 110 as shown in FIG. 4. The distance d.sub.max is a maximum distance inwardly from each respective flange 134 of the web member 130 on the base 112 of the chord member 110. In the embodiment shown in FIG. 4, the distance d.sub.max is 1.25 inches on the second line of markers 170.

The four fasteners 180 placed respectively along the first line of markers 160 and the second line of markers 170 form a four-sided polygon or quadrilateral when connected by phantom lines. This quadrilateral may be a trapezoid as shown in FIG. 4. Additional fasteners may be optionally provided in the trapezoid as desired. Additional fasteners may also be provided on the first line of markers 160 and/or the second lines of markers 170. Such additional fasteners may be provided as necessary and determined by widely known standards such as the American Iron and Steel Institute (AISI). The fasteners may be screws, bolts, rivets or any other type of fastener known in the art. The location of the fasteners and the alignment holes may be marked or punched in the chord and web members during fabrication. Alternatively, the location of the fasteners and the alignment holes may be marked or punched after fabrication of the chord and web members.

Figure 5:
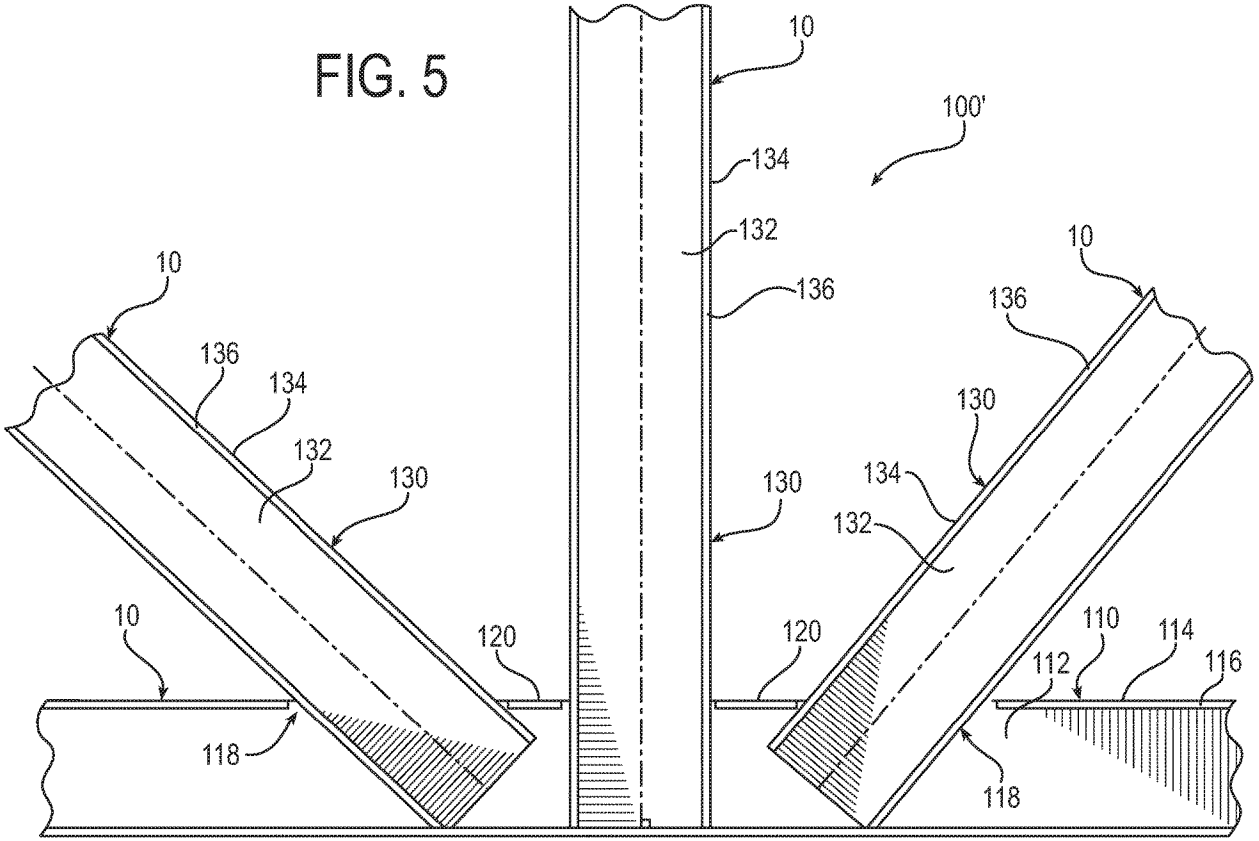
FIG. 5 is a front view of a metal truss assembly according to yet another embodiment of the present invention.

As contemplated by the present invention, any number of web members may intersect the chord member at the cope. In an alternative embodiment, an assembly 100' is shown in FIG. 5. For the sake of brevity, elements in assembly 100' which are similar to the elements in assembly 100 will be referred to with the same reference characters and will not be explicitly described below. Assembly 100' displays three web members 130 intersecting the chord member 110 parts 120 of the flange 114 of the chord member 110 remaining in place between the cutouts 118. One of the web members 130 is substantially vertical with respect to the chord member 110. In other words, the angle between this vertical web member 130 and the chord member 110 is approximately 90 degrees.

Figure 6A:
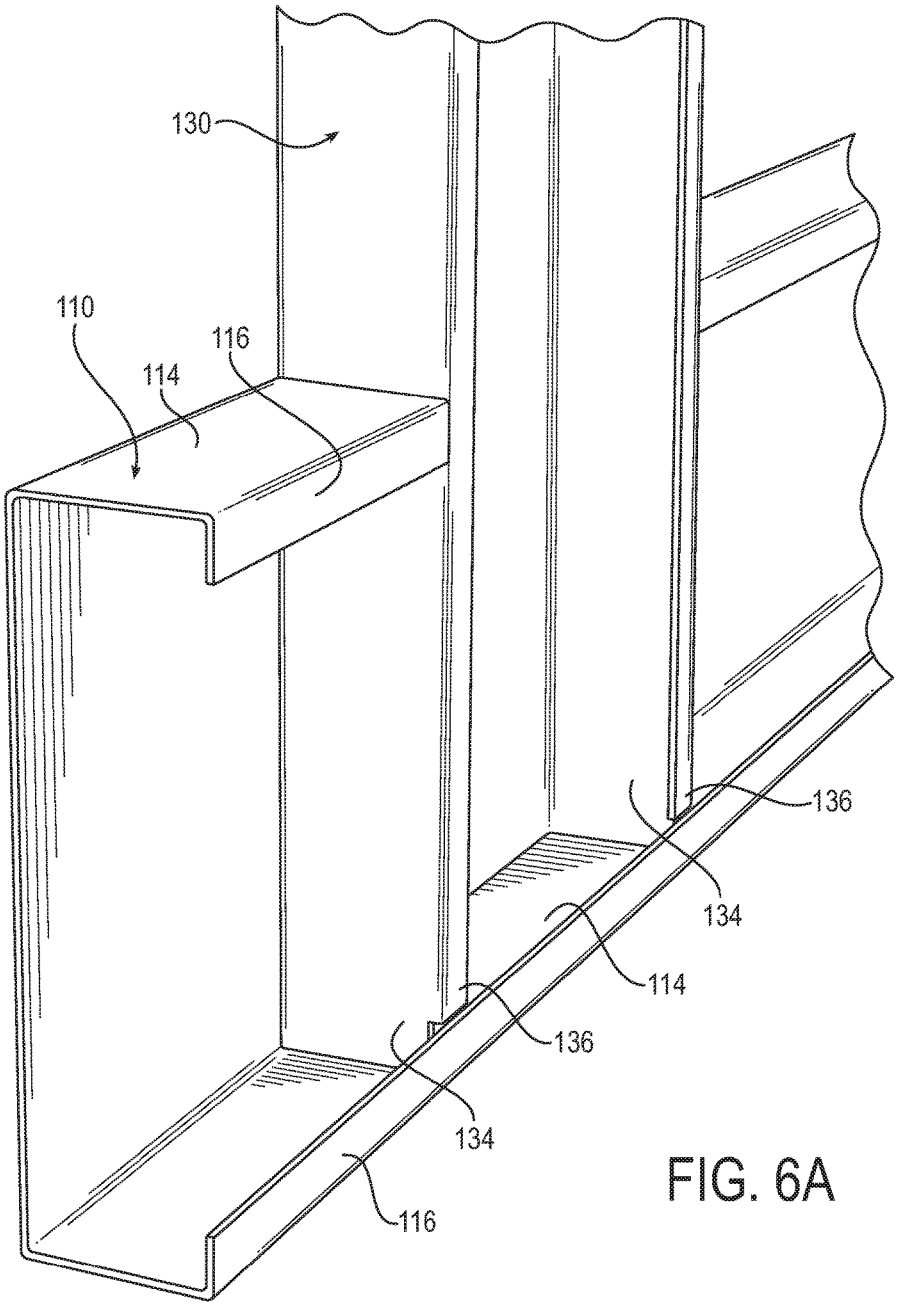
FIG. 6*a* is a perspective view of a vertical web member intersecting a chord member according to another embodiment of the present invention.

For vertical web members, the web member 130 may be seated within the chord member 110 such that the end 18 of the web member 130 is in contact with the flange 114 of the chord member 110 as shown in FIG. 6*a*. A portion of the flanges 134 and their lips 136 at the end 18 of the web member are notched or removed to allow the web member 130 to fit inside the flanges 114 of the chord member as seen in FIG. 6*a*. If there is a support underneath the truss at the location of the vertical web member 130 intersecting the chord member 110, this configuration transfers the load of the truss to the support underneath. The support underneath the truss may be a wall, beam or some other structure that the truss rests upon. This condition is applicable to the interior or exterior supports or any type of orientated support for transferring the load from the truss to the wall, beam or other structure.

Figure 6B:
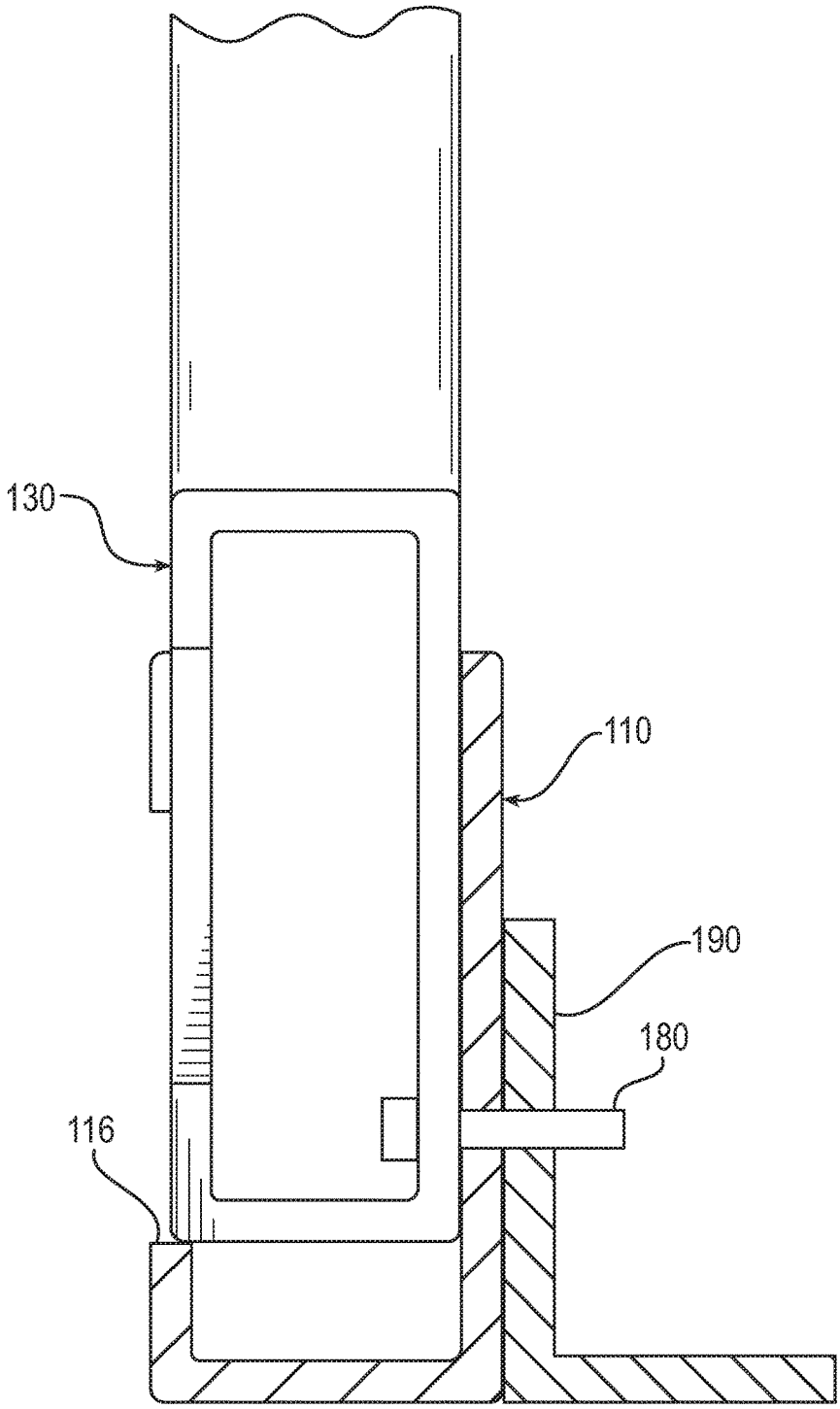
FIG. 6*b* is a side view of a vertical web member intersecting a chord member according to alternative embodiment of the present invention.

In an alternative embodiment of FIG. 6*b*, the vertical web member 130 is seated within the chord member 110 such that the web member 130 is in contact with the lip 116 of the chord member 110. If there is a support underneath the truss at this location, an angle support 190 may be used to support the connection of the vertical web member 130 and the chord member 110 as shown in FIG. 6 to transfer the load of the truss to the support underneath. The support underneath the truss may be a wall, beam or some other structure that the truss rests upon. The angle support 190 may be an interior support, an exterior support or any type of orientated support for transferring the load from the truss to the wall, beam or other structure. Fasteners 180 may be used to secure angle support 190 to the chord member 110. Fasteners 180 may be located 1 inch above the bottom of the chord member. This angle support 190 reduces or eliminates any possible web crippling that may occur in the chord member 110.

Figure 7:
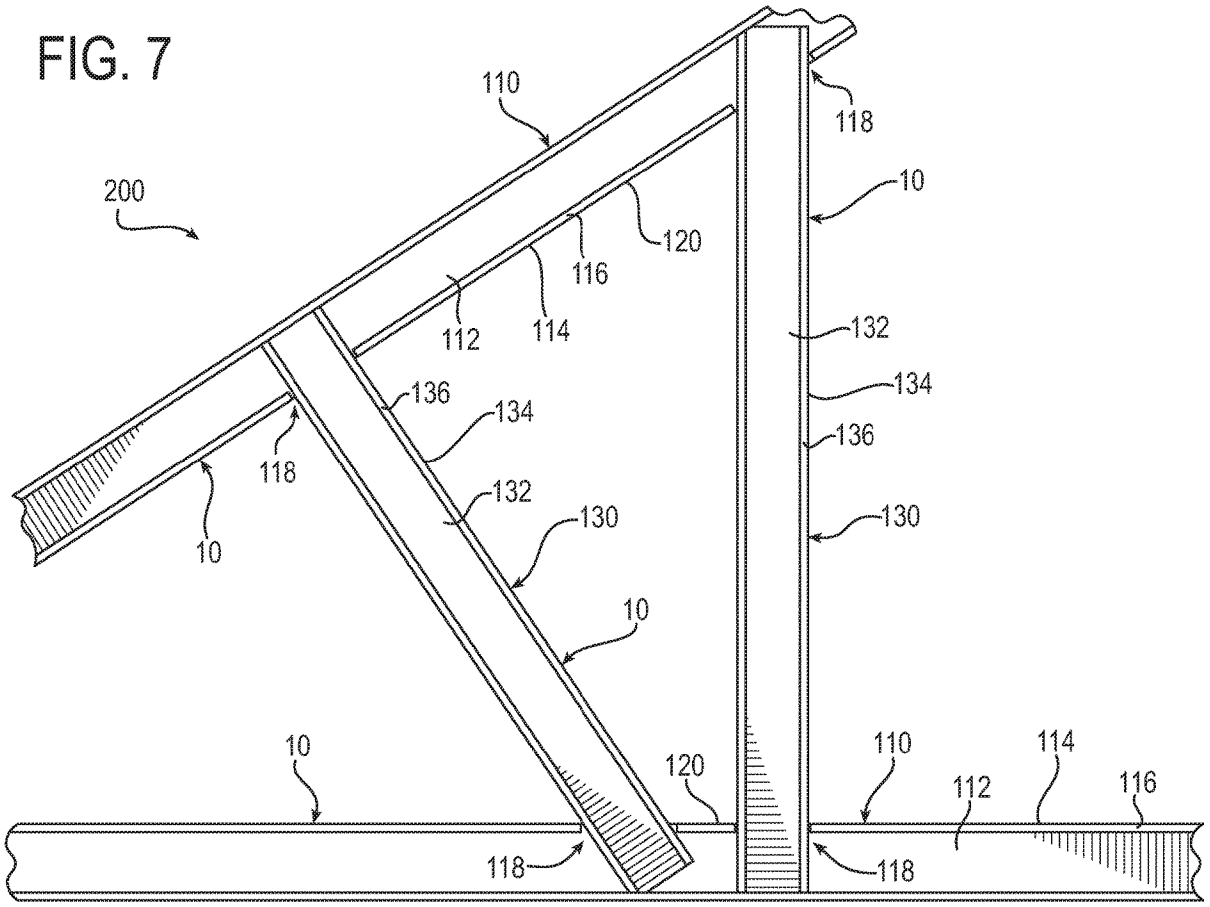
FIG. 7 is a front view of a metal truss assembly showing two web members placed between two chord members according to still another embodiment of the present invention.

As further contemplated by the present invention, any number of web members may intersect more than one chord member. In another embodiment, an assembly 200 is shown in FIG. 7. For the sake of brevity, elements in assembly 200 which are similar to the elements in assembly 100 will be referred to with the same reference characters and will not be explicitly described below. Assembly 200 displays two web members 130 placed between two chord members 110. One flange 114 of each chord member 110 includes cutouts 118 to receive the web members 130 with a part 120 of the flange 114 of each chord member 110 remaining in place between the cutouts 118. The bases 112 of the chord members 110 and the bases 132 of the web members 130 are directly attached. The chord members 110 are shown as being transverse to one another in FIG. 7. Alternatively, the chord members 110 may be substantially parallel to each other.

Figure 8:
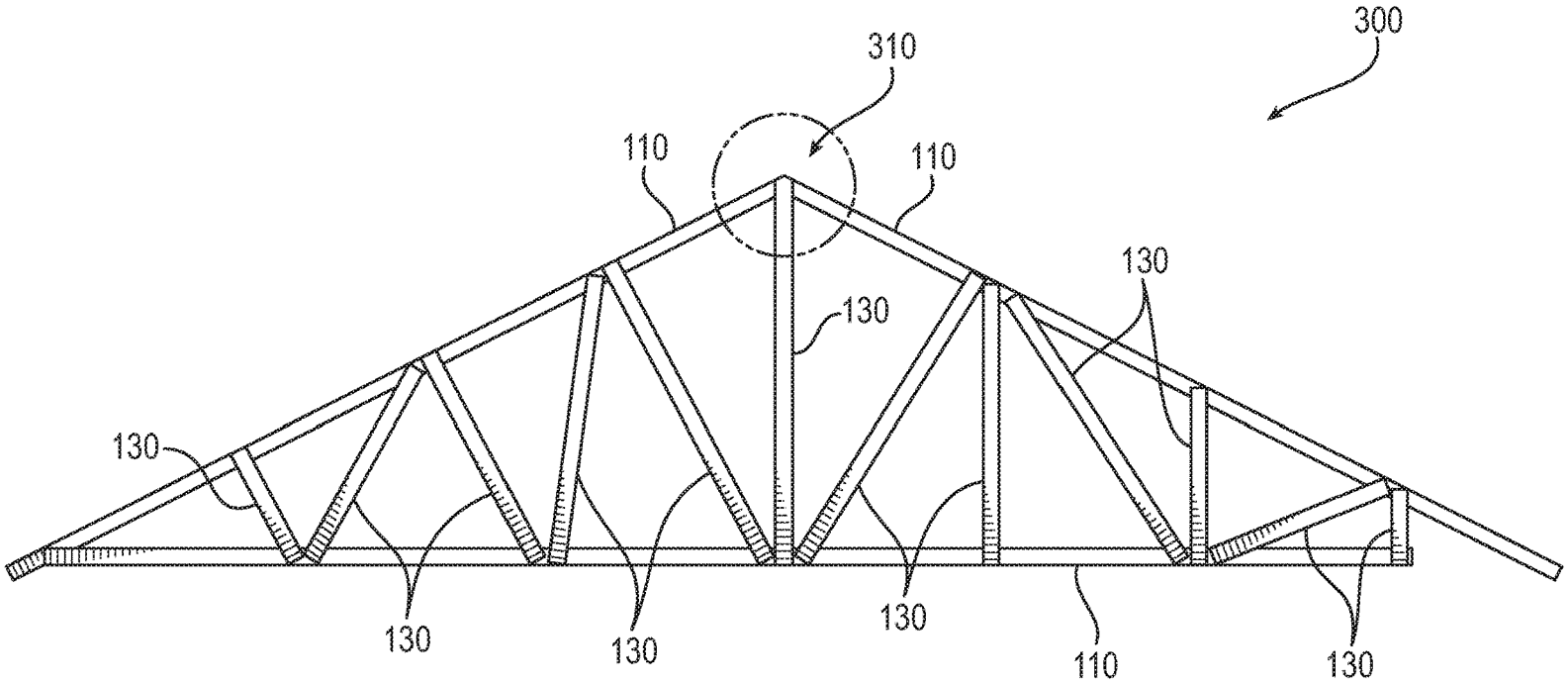
FIG. 8 is a front view of a completed truss assembly according to yet another embodiment of the present invention.
Figure 9:
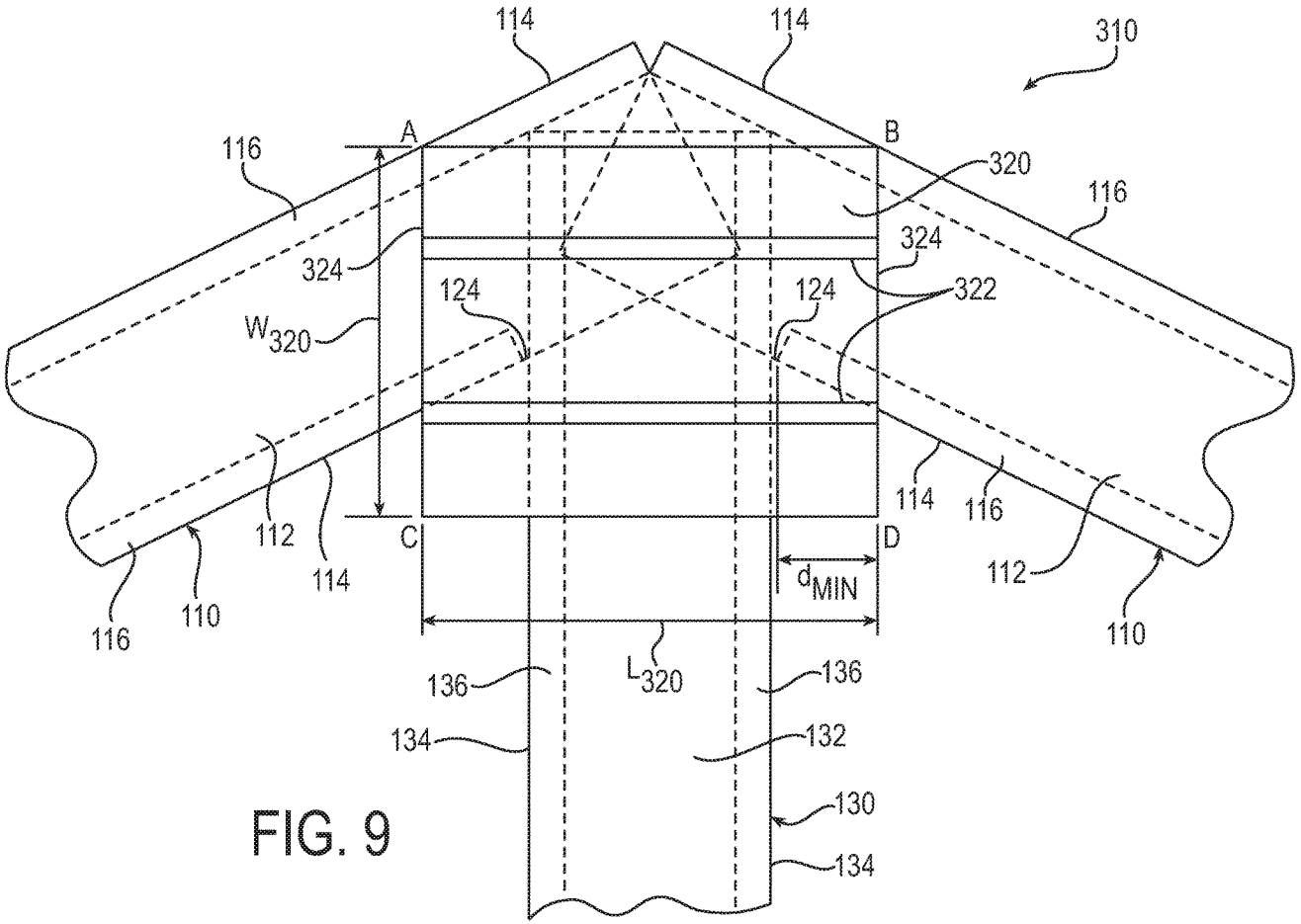
FIG. 9 is a rear view of a peak of a metal truss assembly including a gusset plate according to an embodiment of the invention.

FIG. 8 displays a completed truss assembly 300 according to an embodiment of the present invention. As noted above, elements in assembly 300 which are similar to the elements in assembly 100 will be referred to with the same reference characters and will not be explicitly described below. Assembly 300 displays a plurality of web members 130 and a plurality of chord members 110. Two chord members 110 intersect with one web member 130 at the peak 310 of the assembly 300. In an alternative embodiment, the chord members 110 may intersect at a peak or pitch break without any web member 130. A pitch break is defined as a change in the slope of the chord member. For example, a chord member may be angled and intersect a horizontal chord member, where the intersection of the chord members results in a change in slope (i.e. from angled to horizontal). In order to further secure the intersection of the two chord members 110 and the one web member 130 at the peak 310 of the assembly 300, a gusset plate 320 may be used as seen in FIG. 9. Any number of gusset plates 320 may be used to secure any number of chord members or any number of chord members and web members. FIG. 9 is a rear view of the assembly 300 where the gusset plate 320 is attached to the bases 112 of the chord members 110 and the base 132 of the web member 130. Portions of the flanges 114 of the chord members 110 located opposite the peak 300 are coped or removed to allow for the intersection or overlapping of the chord members 110 and the vertical web member 130 at the peak 310. With references to FIGS. 9 and 10, the gusset plate 320 includes a length L.sub.320, a width W.sub.320 and a thickness T.sub.320. As shown, the gusset plate 320 covers the cope or intersection of the chord members 110 and the web member 130. The gusset plate 320 includes top corners A and B and bottom corners C and D. The top corners A and B of the gusset plate 320 are located within the boundaries of the flanges 114 of the chord members 110. In other words, the top corners A and B extend up to but not beyond the flanges 114 of the chord members 110. Stated another way, the top corners A and B of the gusset plate 320 do not extend beyond the bases 112 of the chord members 110. The bottom corners C and D of the gusset plate 320 extend beyond the edges 124 of the cope (i.e. the edges of the cut in the flanges 114 of the chord members 110). Corners C and D are located a minimum distance d.sub.min outwardly from the edges 124 of the cope. In the embodiment shown in FIG. 9, the distance d.sub.min is 1.5 inches.

Figure 9A:
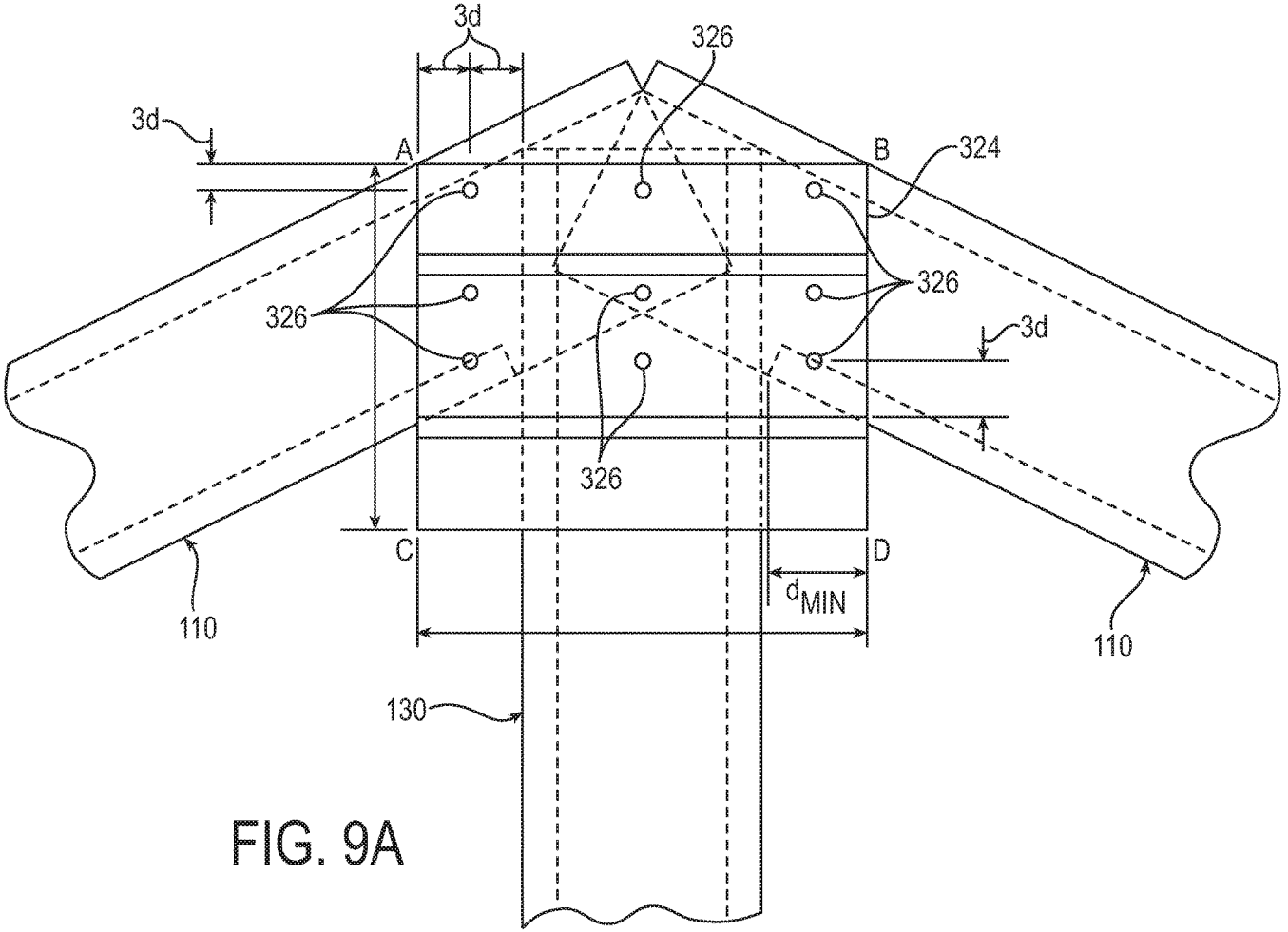
FIG. 9A is a rear view of a peak of a metal truss assembly of FIG. 9 showing the location of the fasteners.
Figure 10:
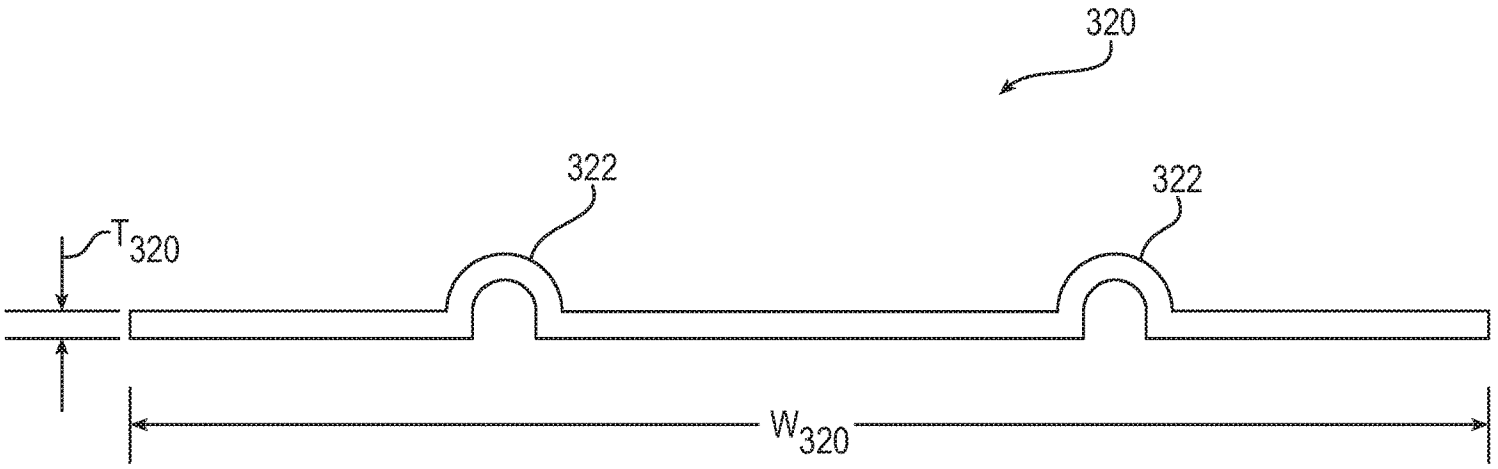
FIG. 10 is a side view of the gusset plate as shown in FIG. 9.

The gusset plate may also include strengthening ribs 322 as seen in FIGS. 9, 9A and 10. The ribs 322 are parallel to each other and extend across the entire length L.sub.320 of the gusset plate 320. The ribs 322 are rounded as shown in FIG. 10, but may be square, triangular, angled or any other configuration known in the art. In an alternative embodiment, the ribs may be configured in a non-parallel arrangement. The gusset plate may also have only a single rib 322 or any number of ribs 322.

As seen in FIG. 9A, fasteners 326 may be used to secure the gusset plate 320 to the chord members 110 and the web member 130. At least one fastener 326 connects the gusset plate 320 to each chord member 110 and is located a minimum distance 3 d (i.e. 3.times. the diameter of the fastener) inwardly from the edge AC of the gusset plate 320 and inwardly from the edge AB of the gusset plate 320 as seen in FIG. 9A meeting the American Iron and Steel Institute (AISI) requirements of minimum edge and end distances. This same fastener 326 is also located a minimum distance 3 d outwardly (i.e. laterally) from the edge of the cope 124 as seen in FIG. 9A. Additional fasteners may be included as necessary and determined by the software or computer program, discussed further below, using AISI guidelines. In the embodiment of FIG. 9A, a total of six fasteners 326 are used to secure the gusset plate 320 to the chord members 110 and the web member 130. The fasteners may be screws, bolts, rivets or any other type of fastener known in the art. In another embodiment, the gusset plate 320 may secure one or more chord members 110 with one or more web members 130. In still another embodiment, the gusset plate 320 may secure two or more chord members 110 together. In yet another embodiment, the gusset plate 320 may secure two or more web members 130 together.

In addition to the above, the various chord members 110 and web members 130, as well as any other parts of the overall truss assembly, may be marked in any number of ways in order to ease assembly of these members. Such markings may include letters, numbers, symbols, shapes or any combination of each, and these examples are not meant to exhaustive of the types of markings available. Additionally, these markings may be printed, embossed, etched or marked in any known manner on the various chord and web members or other parts of the truss assembly. These markings are predetermined by software or a computer program prior to the fabrication of the chord and web members based upon the specific truss assembly being created. Thus, such markings, as further described below, are created during the formation of the various chord and web members as well as other parts of the metal truss assembly.

Figure 11:
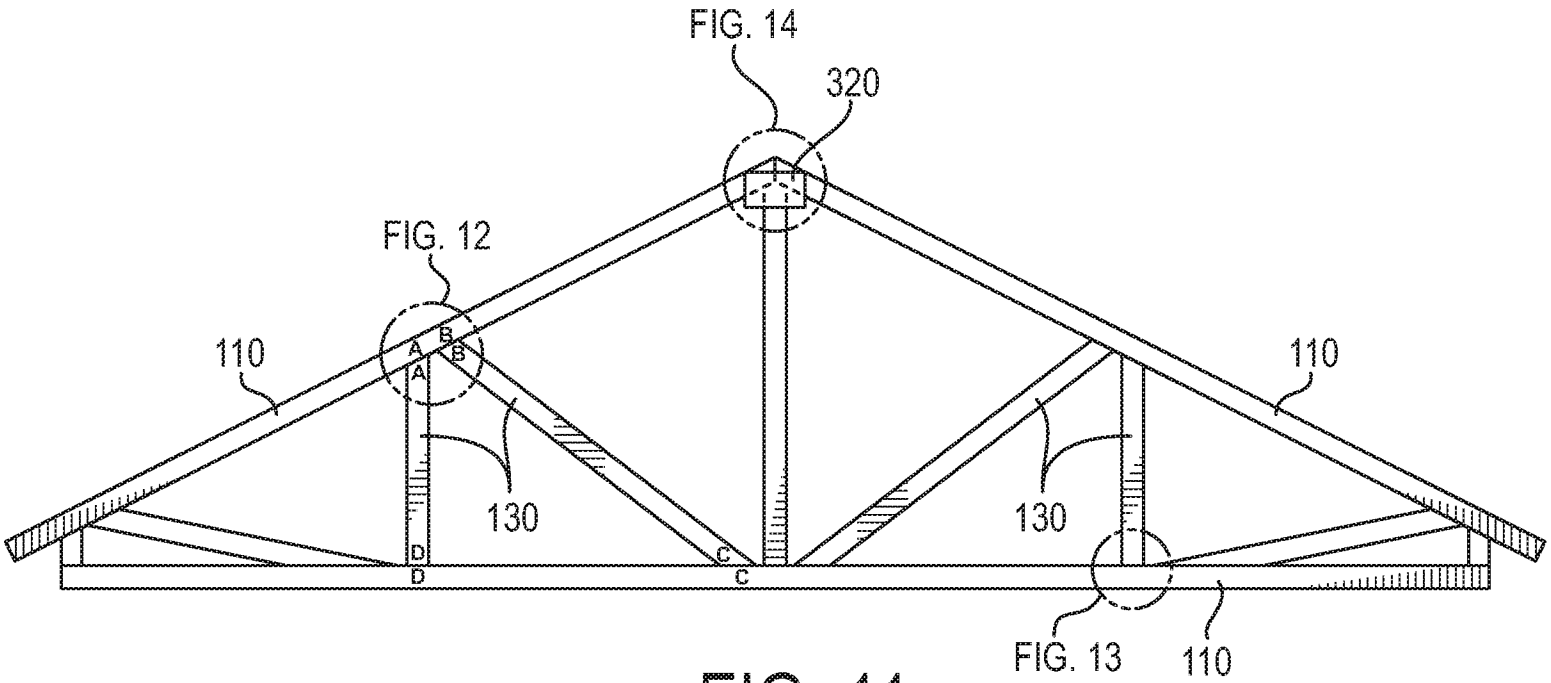
FIG. 11 is a front view of a completed truss assembly showing various markings.

In one embodiment, and as seen in FIG. 11, the chord members 110 and the web members 130 each have joint markings AA, BB, CC, DD that match each joint up with one another, where a joint is the intersection of a chord member 110 with another chord member 110 or one or more web members 130. The joint markings AA, BB, CC, DD allow for ease of assembly because the intersection of various chord and web members are easily identified. Additionally, the joint markings AA, BB, CC, DD provide confirmation of proper assembly of the various chord and web members. These joint markings eliminate incorrect assembly of the various chord and web members and thus reduces labor, time and costs associated with the assembly of the truss assembly in the field.

Figure 12:
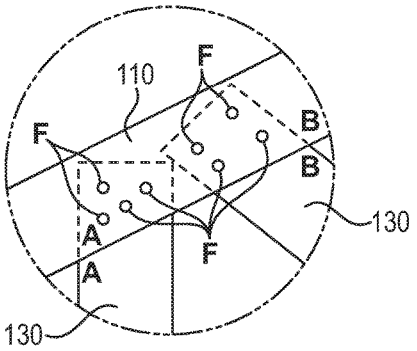
FIG. 12 is a enlarged view of a portion of the completed truss assembly as assembly shown in FIG. 11.

In one embodiment, the joint markings are printed on the various chord and web members. This printing may be done during fabrication of the various chord and web members where a printer imparts the joint markings during the roll forming process as further discussed below. Alternatively, the printing may be done after fabrication of the various chord and web members. FIG. 12 shows an enlarged view of a joint of FIG. 11 displaying the intersection of chord member 110 with web members 130 with joint markings AA, BB. In this embodiment, web member 130 includes joint marking A located at the end of web member 130 and chord member 110 includes the corresponding joint marking A. The joint markings may be located anywhere near the intersection of the chord and web members to allow for ease of proper assembly of the metal truss.

In addition to the above-described marking, the various chord and web members and other parts of the truss assembly may include fastener markings to designate the required fastener pattern for proper assembly. As noted previously herein, the fasteners may be screws, bolts, rivets or any other type of fastener known in the art. Again, such fastener markings may be printed, embossed, etched or marked in any known manner on the various chord and web members or other parts of the truss assembly. These fastener markings are predetermined by software or a computer program prior to the fabrication of the chord and web members based upon the specific truss assembly being created.

Figure 13:
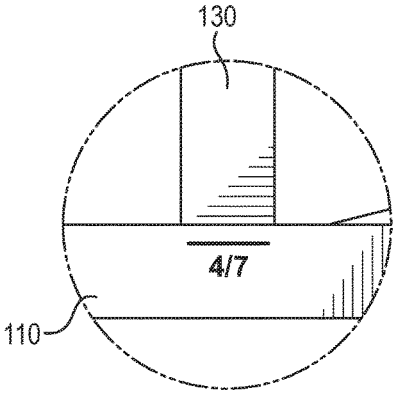
FIG. 13 is another and view of another portion of the completed truss assembly shown in FIG. 11.

In one embodiment, and as seen in FIG. 12, each fastener location is printed on the chord member 110 at the joint as shown by fastener markings F. Fastener markings F indicate the required location of fasteners to be installed upon assembly. Additionally, the chord and web members may be marked to also include the required number of fasteners to be installed at a specific location upon assembly. These fastener markings may also include a line on a chord member indicating that a specific number of fasteners are required at a specific location and the total number of fasteners required at the joint. In the embodiment shown in FIG. 13, a short horizontal line is located above the numbers 4/7 on chord member 110 which indicates where four fasteners must be placed along the line and that a total of seven fasteners are required at the joint.

Figure 14:
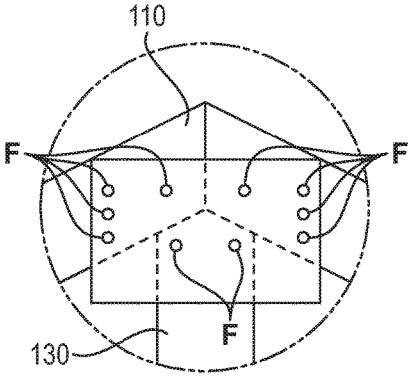
FIG. 14 is an enlarged view of still another portion of the completed truss assembly shown in FIG. 11.

The above fastener markings are not limited to being placed on the various chord and web members, but can be placed on other parts of the truss assembly. For example, fastener markings may be placed upon a gusset plate. In one embodiment, FIG. 14 shows an enlarged view of gusset plate 320 as seen in FIG. 11. The gusset plate 320 includes fastener markings F to indicate the required location of fasteners to be installed upon assembly. Again, these fastener markings are predetermined by software or computer program prior to the fabrication of the gusset plate, chord and web members based upon the specific truss assembly being created.

In addition to the above-described joint markings and fastener markings, it is contemplated that the metal truss assembly can include any other type of marking to allow for ease of assembly. These other types of markings can be predetermined by software or computer program prior to the fabrication of the chord and web members based upon the specific truss assembly being created.

Figure 15:
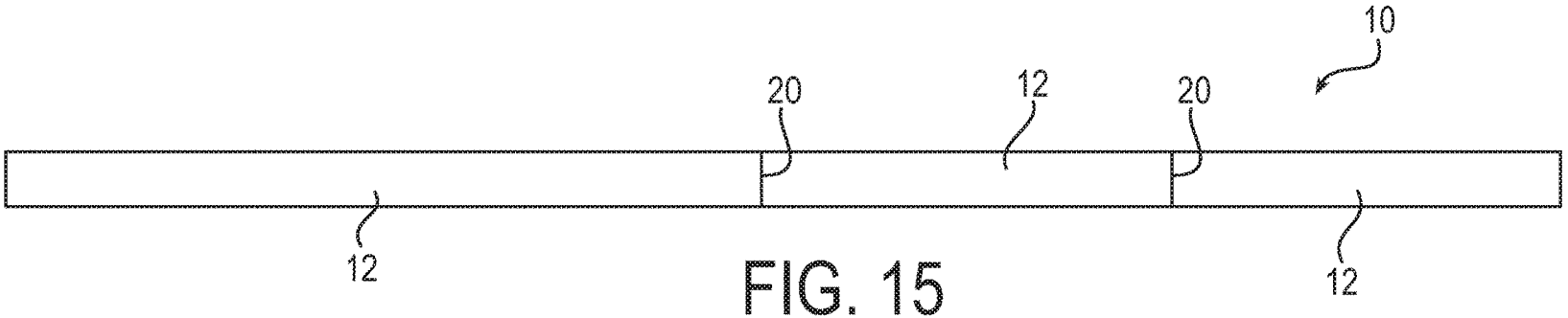
FIG. 15 is a front view of a C-shape member showing pre-partial cuts.
Figure 16:
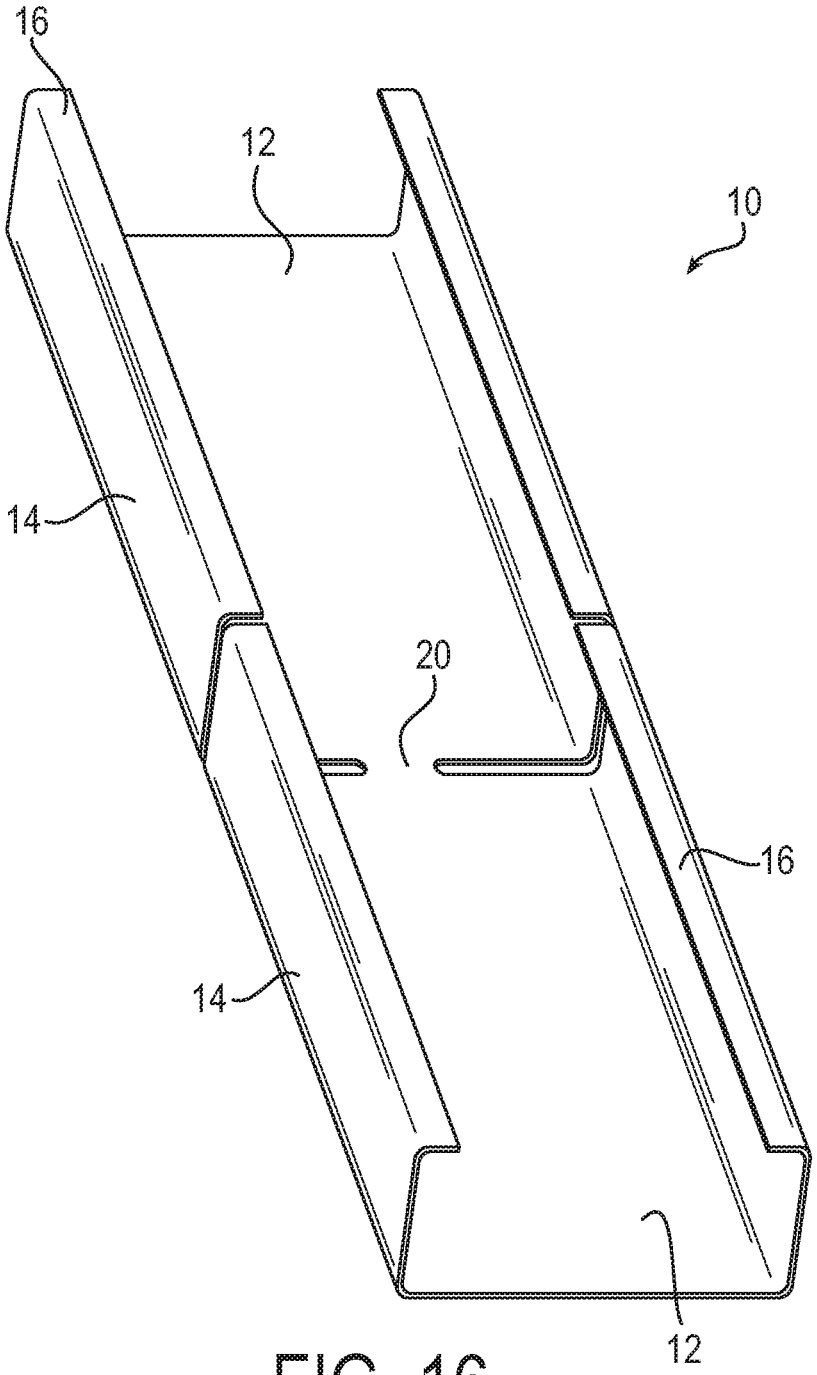
FIG. 16 is an enlarged view of the C-shape member shown in FIG. 15.

In order to ease transfer and subsequent assembly of the metal truss at the assembly location, some of the C-shape members are pre-partially cut. However, the C-shape members are not completely separated or detached until arrival at the assembly location. As shown in FIGS. 15 and 16, a C-shape member 10 is pre-partially cut through the opposing flanges 14. Although not shown in FIG. 15, the C-shape member 10 may include a lip attached to the flange 14, and the lip would also be pre-partially cut through along with the flange 14. With continued reference to FIG. 15, the C-shape member 10 is also pre-partially cut through a portion of the base member 12. A base connecting portion 20 remains after the pre-partial cut of the base member 12. The base connecting portion 20 allows the pre-partially C-shape member to remain a one-piece or unitary part until the C-shape member is separated or detached at the assembly location. A C-shape member may include more than one base connecting portion 20 to allow the C-shape member to be separated or detached into multiple C-shape members having shorter lengths. In order to separate or detach the C-shape member, any number of known methods can be utilized including, but not limited to, snapping, bending, perforating, and cutting. The pre-partially cut C-shape members may be transferred in bundles to the assembly location to be subsequently separated for assembly of the metal truss assembly in accordance with the computer program thereof. This eliminates the possibility of any C-shape members being misplaced or lost during loading and delivery to the assembly location.

In a method for producing a truss assembly according to the present invention, truss members can be produced from flat coils of sheet metal using an automated roll forming machine. A suitable roll forming machine may include a processor, such as a computer, programmed and controlled to produce the structural truss members for the truss assembly according to a predetermined plan. The roll forming machine is provided with the details of the parts that make up the truss assembly to be produced. The various truss members are generated to an appropriate length and having the necessary features for joining the truss members, including holes for fasteners and flanges removed to accommodate intersecting truss members as well as the various markings, including both joint and fastener markings, discussed above. The alignment holes are positioned to align with alignment holes on mating structural truss members so the parts of the truss assembly may be easily and quickly assembled. There is no need for boring or punching holes during the assembly of the truss assembly. Additionally, service holes may be provided in the structural truss members to accommodate electrical wiring or other utilities. Using the method according to the present invention, a finished truss assembly is built from a single strip of flat coil metal stock, which significantly reduces the need to maintain inventory because there is no need for pre-manufactured stock length material.

The computer-controlled roll forming machine will produce the truss members precisely according to the specifications determined by the processor. Thus, the design and production process for the truss assemblies for buildings is substantially automated. Moreover, since all of the truss members are formed with a common cross-section, production is simplified. The truss members are produced in a convenient order, enabling each truss member after the first to be immediately assembled with the previous truss members as the truss member is produced and without any subsequent forming operations. Furthermore, because the holes and intersecting ends of truss members are automatically formed by the roll forming machine, the truss members can be simply fitted and secured together without the need for special framing jigs to hold the truss members in position while holes are drilled, which eliminates the need for setup tables and the time required to layout the trusses prior to fabrication. The truss assemblies may be assembled with the use of simple free standing rests which are moveable, as required, to a convenient location to hold the truss members at a convenient height. This allows the truss to be easily assembled at the assembly location or construction site.

The design of the truss assemblies and operation of the roll forming machine as described above are done with unique software or computer program to create the proper shape, size and configuration of the parts of the assembly. This software or computer program provides a detailed drawing during production, including the location within the final assembly of the each truss member being produced, to simplify the fabrication process and to assure correct assembly at the assembly location or construction site.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The terms "at least one" and "one or more" are used interchangeably. The term "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (i.e., not required) feature of the invention. Ranges that are described as being "between a and b" are inclusive of the values for "a" and "b" unless otherwise specified.

While this invention has been described with reference to particular embodiments thereof, it shall be understood that such description is by way of illustration only and should not be construed as limiting the scope of the claimed invention. Accordingly, the scope and content of the invention are to be defined only by the terms of the following claims. Furthermore, it is understood that the features of any specific embodiment discussed herein may be combined with one or more features of any one or more embodiments otherwise discussed or contemplated herein unless otherwise stated.

The invention claimed is:

1. A method of creating a metal truss assembly, comprising:

providing a plurality of C-shape structural members including at least one upper chord member, at least one lower chord member and a plurality of web members connected between the upper and lower chord members, each chord member having a chord base and two opposing chord flanges, and each web member having a web base with a width and two opposing web flanges, the two opposing chord flanges extend from each chord base;

forming a plurality of cutouts in one of the two opposing chord flanges of each chord member;

each of said chord members and each of said web members having a lip on each of their two opposing and respective chord flanges and web flanges, said lips extending inwardly from the respective flanges and being spaced from each other for each of said chord member and web member, each of said plurality of cutouts extending through said lips;

inserting ends of at least two of the web members into two respective cutouts of the chord flanges of each of the upper and lower chord members, each chord base being parallel to each web base and all the flanges extending in the same direction, with at least some of the chord bases overlapping at least some of the web bases at a plurality of copes, each cope being near an end of one of said plurality of web members and adjacent one of said plurality of cutouts;

providing an alignment hole in each of said web bases that is at each cope and providing an alignment hole in each of said chord bases that is at each cope;

aligning the alignment holes of the web base and the chord base of each cope for positioning the web members with respect to the chord members;

fastening the web members to the chord members using a plurality of fasteners in each cope, the fasteners being spaced from each other and being spaced from each respective alignment hole of a respective cope, the fasteners extending through the web base and through the chord base at each respective cope for connecting the chord members to the web members; and forming in the lower chord member at least two spaced apart ones of said cutouts in one of the chord flanges of said lower chord member, with a remaining part of said one of the chord flanges with respective lips of said lower chord member remaining between the at least two spaced apart ones of said cutouts, one end of one web member being received in each of the spaced apart ones of the cutouts, said remaining part being between web flanges and respective lips of each of said one web member, said remaining part being less than the width of the web base.

2. The method of claim 1, including providing two upper chord members having ends with chord bases that intersect each other at one of the copes, each upper chord member having one of said cutouts at said one of said copes receiving an end of one of the web members at said one of said copes, providing a gusset plate extending over at least some of said one of said copes, and fastening a plurality of said fasteners through the gusset plate, through the web base and through the chord base at said one of said copes for connecting the upper chord members to the web member and gusset plate at said one of said copes.

3. The method of claim 1, including intersecting the web members with the chord members at different angles.

4. The method of claim 1, including providing a first line of markers on each web base, spaced from the end of each web base, the first line of markers being in one of the copes and being spaced from the alignment hole for marking a position for at least one of the fasteners, and providing a second line of markers on each chord base near one of said cutouts and spaced from the chord flange with the cutout, the second line of markers being in the cope and being spaced from the alignment hole for marking a position for at least one of the fasteners.

5. The method of claim 1, wherein each chord member and web member has a centerline axis, the alignment holes being provided in each base along the centerline axis of each web and chord member.

6. The method of claim 1, including providing a first line of markers on each web base that are spaced from the end of each web base, the first line of markers being in one of the copes and being spaced from the alignment hole for marking a position for at least one of the fasteners, and providing a second line of markers on each chord base near one of said cutouts and spaced from the chord flange with the one of said cutouts, the second line of markers being in the cope and being spaced from the alignment hole for marking a position for at least one of the fasteners, each chord member and web member having a centerline axis, the alignment holes being in each base along the centerline axis of each web and chord member.

7. A method a making a metal truss assembly, comprising:

providing a plurality of C-shape structural members including two upper chord members, at least one lower chord member and a plurality of web members connected between the upper and lower chord members;

providing each chord member with a chord base and two opposing chord flanges, each web member having a web base with a width and two opposing web flanges, all the flanges of all of the chord members and web members extending in the same direction;

placing each chord base parallel to each web base with at least some of the chord bases overlapping at least some of the web bases at a plurality of copes, each cope being near an end of a web member, the two upper chord member bases also overlapping each other at one of the copes;

forming a plurality of cutouts in the two opposing chord flanges that extend from each chord base, each of the upper and lower chord members receiving an end of at least two of the web members at two of the cutouts, each cope being adjacent one of said cutouts;

each of said chord members and each of said web members having a lip on each of their two opposing and respective chord flanges and web flanges, said lips extending inwardly from the respective flanges and being spaced from each other for each of said chord member and web member, each of said plurality of cutouts extending through said lips;

providing an alignment hole in each of said web base and each of said chord base, at each respective cope, the alignment holes being aligned to properly position the web members with respect to the chord members;

fastening a plurality of fasteners in each cope, the fasteners being spaced from the alignment holes of a respective cope and extending through the web base and chord base at each cope for connecting the chord members to the web members; and forming in the lower chord member at least two spaced apart ones of said cutouts in one of the chord flanges of said lower chord member, with a remaining part of said one of the chord flanges of said lower chord member remaining between the at least two spaced apart ones of said cutouts, one end of one web member being received in each of the spaced apart ones of the cutouts, said remaining part being between web flanges of each of said one web member, said remaining part being less than the width of the web base.

8. The method of claim 7, including providing a gusset plate over at least one of said copes, and some of said plurality of fasteners extending through the gusset plate, the web base and the chord base at said one of said copes for connecting the upper chord members to the web member and gusset plate at said one of said copes.

9. The method of claim 7, including intersecting the web members with the chord members at different angles.

10. The method of claim 7, including providing a first line of markers on each web base, spaced from the end of each web base, the first line of markers being in one of the copes and being spaced from the alignment hole for marking a position for at least one of the fasteners, and providing a second line of markers on each chord base near one of said cutouts and spaced from the chord flange with the cutout, the second line of markers being in the cope and being spaced from the alignment hole for marking a position for at least one of the fasteners.

11. The method of claim 10, wherein each chord member and web member has a centerline axis, the alignment holes being in each base along the centerline axis of each web member and chord member.

12. The method of claim 7, including providing a first line of markers on each web base, spaced from the end of each web base, the first line of markers being in one of the copes and being spaced from the alignment hole for marking a position for at least one of the fasteners, and providing a second line of markers on each chord base near a cutout and spaced from the chord flange with the cutout, the second line of markers being in the cope and being spaced from the alignment hole for marking a position for at least one of the fasteners, each chord member and web member having a centerline axis, the alignment holes being in each base along the centerline axis of each web and chord member.

* * * * *